US007497665B2

(12) United States Patent
King et al.

(10) Patent No.: US 7,497,665 B2
(45) Date of Patent: Mar. 3, 2009

(54) AIRFOIL SHAPE FOR A COMPRESSOR

(75) Inventors: Peter King, Simpsonville, SC (US); Amit Kumar Paspulati, Bangalore (IN)

(73) Assignee: General Electric Company, Schenectady, NY (US)

( * ) Notice: Subject to any disclaimer, the term of this patent is extended or adjusted under 35 U.S.C. 154(b) by 295 days.

(21) Appl. No.: 11/591,691

(22) Filed: Nov. 2, 2006

(65) Prior Publication Data

US 2008/0229603 A1 Sep. 25, 2008

(51) Int. Cl.
*F01D 5/14* (2006.01)

(52) U.S. Cl. ..... 416/223 A; 416/DIG. 2

(58) Field of Classification Search ..... None
See application file for complete search history.

(56) References Cited

U.S. PATENT DOCUMENTS 5,980,209 A * 11/1999 Barry et al. ..... 416/223 A
6,398,489 B1 * 6/2002 Burdgick et al. ..... 415/191
6,450,770 B1 * 9/2002 Wang et al. ..... 416/223 A
6,461,109 B1 * 10/2002 Wedlake et al. ..... 416/223 R
6,461,110 B1 * 10/2002 By et al. ..... 416/223 A
6,474,948 B1 * 11/2002 Pirolla et al. ..... 416/223 A
6,503,054 B1 * 1/2003 Bielek et al. ..... 415/191
6,503,059 B1 * 1/2003 Frost et al. ..... 416/223 A
6,558,122 B1 * 5/2003 Xu et al. ..... 416/223 A
6,685,434 B1 * 2/2004 Humanchuk et al. .... 416/223 A
6,715,990 B1 * 4/2004 Arness et al. ..... 416/223 A
6,722,852 B1 * 4/2004 Wedlake et al. ..... 416/223 A
6,722,853 B1 * 4/2004 Humanchuk et al. .... 416/223 A
6,736,599 B1 * 5/2004 Jacks et al. ..... 415/191
6,739,838 B1 * 5/2004 Bielek et al. ..... 416/223 A
6,739,839 B1 * 5/2004 Brown et al. ..... 416/223 A
6,769,878 B1 * 8/2004 Parker et al. ..... 416/223 A
6,769,879 B1 * 8/2004 Cleveland et al. ..... 416/223 A
6,779,977 B2 * 8/2004 Lagrange et al. ..... 416/223 A
6,779,980 B1 * 8/2004 Brittingham et al. .... 416/223 A
6,808,368 B1 * 10/2004 Tomberg et al. ..... 416/223 A
6,832,897 B2 * 12/2004 Urban ..... 416/223 A
6,854,961 B2 * 2/2005 Zhang et al. ..... 416/223 A
6,857,855 B1 * 2/2005 Snook et al. ..... 416/223 A
6,866,477 B2 * 3/2005 Arness et al. ..... 415/191
6,881,038 B1 * 4/2005 Beddard et al. ..... 416/243
6,884,038 B2 * 4/2005 Hyde et al. ..... 416/223 A
6,887,041 B2 * 5/2005 Coke et al. ..... 415/191
6,910,868 B2 * 6/2005 Hyde et al. ..... 416/223 A
6,932,577 B2 * 8/2005 Strohl et al. ..... 416/223 A
7,001,147 B1 * 2/2006 Phillips et al. ..... 415/191
7,186,090 B2 * 3/2007 Tomberg et al. ..... 416/223 A
7,306,436 B2 * 12/2007 Girgis et al. ..... 416/223 A
7,329,092 B2 * 2/2008 Keener et al. ..... 416/223 A
7,329,093 B2 * 2/2008 Vandeputte et al. ..... 416/223 A
7,351,038 B2 * 4/2008 Girgis et al. ..... 416/223 A
7,354,249 B2 * 4/2008 Girgis et al. ..... 416/223 A (Continued)

*Primary Examiner*—Richard Edgar
(74) *Attorney, Agent, or Firm*—Ernest G. Cusick; Frank A. Landgraff

(57) ABSTRACT

An article of manufacture having a nominal profile substantially in accordance with Cartesian coordinate values of X, Y and Z set forth in a TABLE 1. Wherein X and Y are distances in inches which, when connected by smoothing continuing arcs, define airfoil profile sections at each distance Z in inches. The profile sections at the Z distances being joined smoothly with one another to form a complete airfoil shape.

9 Claims, 4 Drawing Sheets

U.S. PATENT DOCUMENTS 7,367,779 B2 * 5/2008 Girgis et al. ..... 416/223 A
7,384,243 B2 * 6/2008 Noshi ..... 416/223 A
7,396,211 B2 * 7/2008 Tomberg et al. ..... 416/223 A
7,402,026 B2 * 7/2008 Girgis et al. ..... 416/223 A
2003/0017052 A1 * 1/2003 Frost et al. ..... 416/223 A
2003/0021680 A1 * 1/2003 Bielek et al. ..... 415/191
2004/0057833 A1 * 3/2004 Arness et al. ..... 416/223 A
2004/0115058 A1 * 6/2004 Lagrange et al. ..... 416/223 A
2004/0175271 A1 * 9/2004 Coke et al. ..... 416/223 A
2004/0223849 A1 * 11/2004 Urban ..... 416/223 A
2004/0241002 A1 * 12/2004 Zhang et al. ..... 416/223 A
2005/0013695 A1 * 1/2005 Hyde et al. ..... 416/243
2005/0019160 A1 * 1/2005 Hyde et al. ..... 415/213.1
2005/0025618 A1 * 2/2005 Arness et al. ..... 415/191
2005/0031453 A1 * 2/2005 Snook et al. ..... 416/223 A
2005/0079061 A1 * 4/2005 Beddard et al. ..... 416/243
2005/0111978 A1 * 5/2005 Strohl et al. ..... 416/97 R
2006/0024159 A1 * 2/2006 Phillips et al. ..... 415/191
2006/0073014 A1 * 4/2006 Tomberg et al. ..... 416/96 R
2007/0048143 A1 * 3/2007 Noshi ..... 416/223 R
2007/0154316 A1 * 7/2007 Clarke ..... 416/223 R
2007/0154318 A1 * 7/2007 Saltman et al. ..... 416/241 R
2007/0177980 A1 * 8/2007 Keener et al. ..... 416/223 R
2007/0177981 A1 * 8/2007 Vandeputte et al. ..... 416/223 R
2007/0183895 A1 * 8/2007 Sheffield ..... 416/223 R
2007/0183896 A1 * 8/2007 Jay et al. ..... 416/223 R
2007/0183897 A1 * 8/2007 Sadler et al. ..... 416/223 R
2007/0183898 A1 * 8/2007 Hurst et al. ..... 416/223 R
2007/0207035 A1 * 9/2007 Girgis et al. ..... 416/223 A
2007/0207036 A1 * 9/2007 Girgis et al. ..... 416/223 A
2007/0207037 A1 * 9/2007 Girgis et al. ..... 416/223 A
2007/0207038 A1 * 9/2007 Girgis et al. ..... 416/223 A
2007/0231147 A1 * 10/2007 Tomberg et al. ..... 416/223 R
2007/0286718 A1 * 12/2007 Stampfli et al. ..... 415/191
2008/0044287 A1 * 2/2008 Girgis et al. ..... 416/223 R
2008/0044288 A1 * 2/2008 Novori et al. ..... 416/223 R
2008/0056893 A1 * 3/2008 Marini et al. ..... 415/191
2008/0056894 A1 * 3/2008 Tsifourdaris et al. ..... 415/191
2008/0056896 A1 * 3/2008 Trindade et al. ..... 415/208.1
2008/0056901 A1 * 3/2008 Mah et al. ..... 416/223 R
2008/0056902 A1 * 3/2008 Ravanis et al. ..... 416/223 R
2008/0056903 A1 * 3/2008 Girgis et al. ..... 416/223 R
2008/0063530 A1 * 3/2008 Papple et al. ..... 416/223 A
2008/0063531 A1 * 3/2008 Sreekanth et al. ..... 416/223 A
2008/0101925 A1 * 5/2008 Humanchuk et al. ..... 415/208.1
2008/0101940 A1 * 5/2008 LaMaster et al. ..... 416/223 R
2008/0101941 A1 * 5/2008 LaMaster et al. ..... 416/223 R
2008/0101942 A1 * 5/2008 McGowan et al. ..... 416/223 R
2008/0101943 A1 * 5/2008 Columbus et al. ..... 416/223 R
2008/0101944 A1 * 5/2008 Spracher et al. ..... 416/223 R
2008/0101945 A1 * 5/2008 Tomberg et al. ..... 416/223 R
2008/0101946 A1 * 5/2008 Duong et al. ..... 416/223 R
2008/0101947 A1 * 5/2008 Shrum et al. ..... 416/223 R
2008/0101948 A1 * 5/2008 Latimer et al. ..... 416/223 R
2008/0101949 A1 * 5/2008 Spracher et al. ..... 416/223 R
2008/0101950 A1 * 5/2008 Noshi et al. ..... 416/223 R
2008/0101951 A1 * 5/2008 Hudson et al. ..... 416/223 R
2008/0101952 A1 * 5/2008 Duong et al. ..... 416/223 R
2008/0101953 A1 * 5/2008 Huskins et al. ..... 416/223 R
2008/0101954 A1 * 5/2008 Latimer et al. ..... 416/223 R
2008/0101955 A1 * 5/2008 McGowan et al. ..... 416/223 R
2008/0101956 A1 * 5/2008 Douchkin et al. ..... 416/223 R
2008/0101957 A1 * 5/2008 Columbus et al. ..... 416/223 R
2008/0101958 A1 * 5/2008 Latimer et al. ..... 416/223 R
2008/0101959 A1 * 5/2008 McRae et al. ..... 416/223 R
2008/0273970 A1 * 11/2008 Sleiman et al. ..... 415/208.1

* cited by examiner

AIRFOIL SHAPE FOR A COMPRESSOR

BACKGROUND OF THE INVENTION

The present invention is related to the following GE commonly assigned applications: 11/586,060, 11/586,049, 11/586050, 11/586,051, 11/586,052, 11/586,046, 11/586,053, 11/586,054, 11/586,085, 11/586,055, 11/586,088, 11/586,086, 11/586,045, 11/586,087, 11/586,059, 11/586,092, 11/586,090, 11/586,089 and 11/586,091 each filed on Oct. 25, 2006; and the following GE commonly assigned applications: 11/591,695, 11/591,694, 11/591,693 and 11/691,692 each filed on Nov. 2, 2006.

The present invention relates to airfoils for a rotor blade of a gas turbine. In particular, the invention relates to compressor airfoil profiles for various stages of the compressor. In particular, the invention relates to compressor airfoil profiles for either inlet guide vanes, rotors, or stators at various stages of the compressor.

In a gas turbine, many system requirements should be met at each stage of a gas turbine's flow path section to meet design goals. These design goals include, but are not limited to, overall improved efficiency and airfoil loading capability. For example, and in no way limiting of the invention, a blade of a compressor stator should achieve thermal and mechanical operating requirements for that particular stage. Further, for example, and in no way limiting of the invention, a blade of a compressor rotor should achieve thermal and mechanical operating requirements for that particular stage.

BRIEF DESCRIPTION OF THE INVENTION

In accordance with one exemplary aspect of the instant invention, an article of manufacture having a nominal profile substantially in accordance with Cartesian coordinate values of X, Y and Z set forth in Table 1. Wherein X and Y are distances in inches which, when connected by smooth continuing arcs, define airfoil profile sections at each distance Z in inches. The profile sections at the Z distances being joined smoothly with one another to form a complete airfoil shape.

In accordance with another exemplary aspect of the instant invention, a compressor comprises a compressor wheel. The compressor wheel has a plurality of articles of manufacture. Each of the articles of manufacture includes an airfoil having an airfoil shape. The airfoil comprises a nominal profile substantially in accordance with Cartesian coordinate values of X, Y and Z set forth in TABLE 1, wherein X and Y are distances in inches which, when connected by smooth continuing arcs, define airfoil profile sections at each distance Z in inches. The profile sections at the Z distances being joined smoothly with one another to form a complete airfoil shape.

In accordance with yet exemplary another aspect of the instant invention, a compressor comprises a compressor wheel having a plurality of articles of manufacture. Each of the articles of manufacture includes an airfoil having an uncoated nominal airfoil profile substantially in accordance with Cartesian coordinate values of X, Y and Z set forth in TABLE 1, wherein X and Y are distances in inches which, when connected by smooth continuing arcs, define airfoil profile sections at each distance Z in inches. The profile sections at the Z distances being joined smoothly with one another to form a complete airfoil shape.

DETAILED DESCRIPTION OF THE INVENTION

Figure 1:
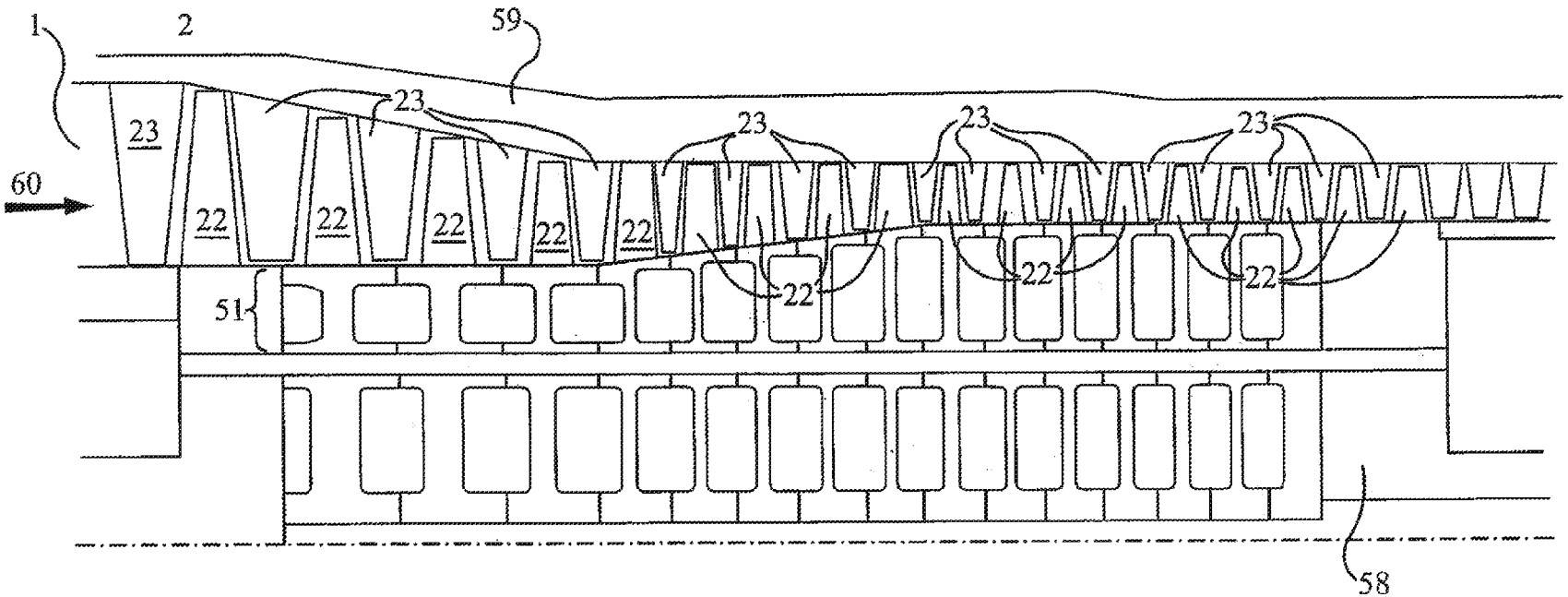
FIG. 1 is a schematic exemplary representation of a compressor flow path through multiple stages of a gas turbine and illustrates an exemplary airfoil according to an embodiment of the invention.
Figure 4:
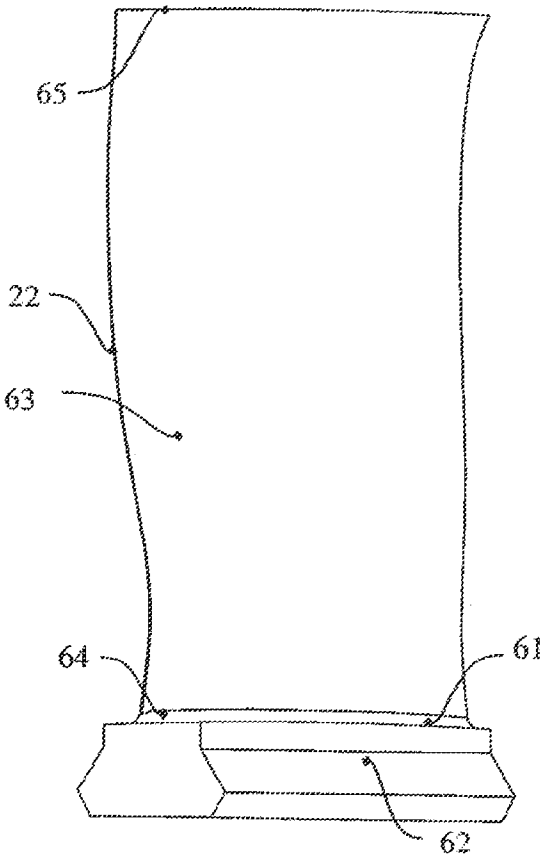
FIGS. 4 and 5 are side elevational views of the rotor blade of FIG. 2 and associated platform and dovetail connection as viewed in a generally circumferential direction from the pressure and suction sides of the airfoil, respectively.
Figure 3:
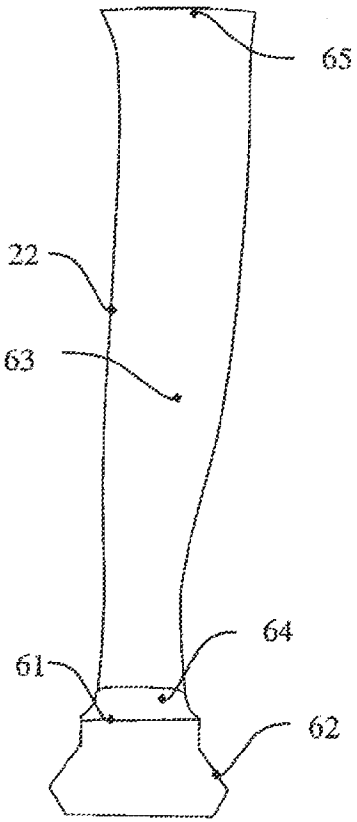
FIGS. 2 and 3 are respective perspective exemplary views of a rotor blade according to an embodiment of the invention with the rotor blade airfoil illustrated in conjunction with its platform and its substantially or near axial entry dovetail connection.
Figure 2:
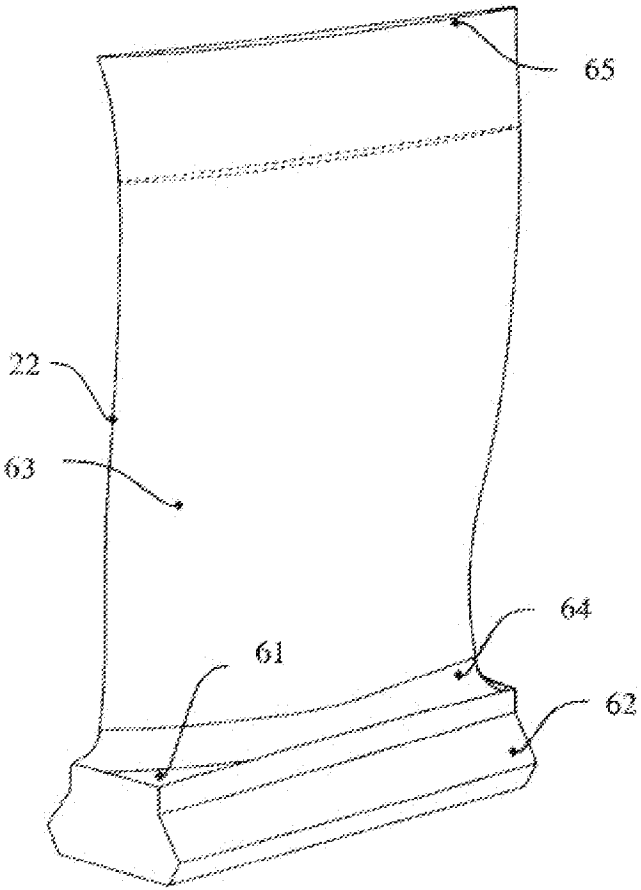

Referring now to the drawings, FIG. 1 illustrates an axial compressor flow path 1 of a gas turbine compressor 2 that includes a plurality of compressor stages. The compressor stages are sequentially numbered in the Figure. The compressor flow path comprises any number of rotor stages and stator stages, such as eighteen. However, the exact number of rotor and stator stages is a choice of engineering design. Any number of rotor and stator stages can be provided in the combustor, as embodied by the invention. The seventeen rotor stages are merely exemplary of one turbine design. The eighteen rotor stages are not intended to limit the invention in any manner.

The compressor rotor blades impart kinetic energy to the airflow and therefore bring about a desired pressure rise across the compressor. Directly following the rotor airfoils is a stage of stator airfoils. Both the rotor and stator airfoils turn the airflow, slow the airflow velocity (in the respective airfoil frame of reference), and yield a rise in the static pressure of the airflow. The configuration of the airfoil (along with its interaction with surrounding airfoils), including its peripheral surface provides for stage airflow efficiency, enhanced aeromechanics, smooth laminar flow from stage to stage, reduced thermal stresses, enhanced interrelation of the stages to effectively pass the airflow from stage to stage, and reduced mechanical stresses, among other desirable aspects of the invention. Typically, multiple rows of rotor/stator stages are stacked in axial flow compressors to achieve a desired discharge to inlet pressure ratio. Rotor and stator airfoils can be secured to rotor wheels or stator case by an appropriate attachment configuration, often known as a "root", "base" or "dovetail" (see FIGS. 2-5).

A stage of the compressor 2 is exemplarily illustrated in FIG. 1. The stage of the compressor 2 comprises a plurality of circumferentially spaced rotor blades 22 mounted on a rotor wheel 51 and a plurality of circumferentially spaced stator blades 23 attached to a static compressor case 59. Each of the rotor wheels is attached to aft drive shaft 58, which is connected to the turbine section of the engine. The rotor blades and stator blades lie in the flow path 1 of the compressor. The direction of airflow through the compressor flow path 1, as embodied by the invention, is indicated by the arrow 60 (FIG. 1). This stage of the compressor 2 is merely exemplarily of the stages of the compressor 2 within the scope of the invention. The illustrated and described stage of the compressor 2 is not intended to limit the invention in any manner.

Figure 6:
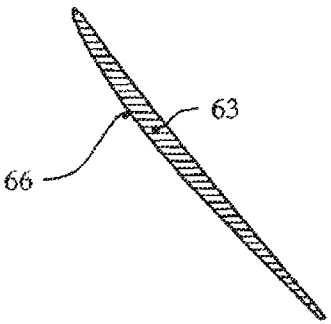
FIG. 6 is a cross-sectional view of the rotor blade airfoil taken generally about on line 6-6 in FIG. 5.

The rotor blades 22 are mounted on the rotor wheel 51 forming part of aft drive shaft 58. Each rotor blade 22, as illustrated in FIGS. 2-6, is provided with a platform 61, and substantially or near axial entry dovetail 62 for connection with a complementary-shaped mating dovetail, not shown, on the rotor wheel 51. An axial entry dovetail, however, may be provided with the airfoil profile, as embodied by the invention. Each rotor blade 22 comprises a rotor blade airfoil 63, as illustrated in FIGS. 2-6. Thus, each of the rotor blades 22 has a rotor blade airfoil profile 66 at any cross-section from the airfoil root 64 at a midpoint of platform 61 to the rotor blade tip 65 in the general shape of an airfoil (FIG. 6).

To define the airfoil shape of the rotor blade airfoil, a unique set or loci of points in space are provided. This unique set or loci of points meet the stage requirements so the stage can be manufactured. This unique loci of points also meets the desired requirements for stage efficiency and reduced thermal and mechanical stresses. The loci of points are arrived at by iteration between aerodynamic and mechanical loadings enabling the compressor to run in an efficient, safe and smooth manner.

The loci, as embodied by the invention, defines the rotor blade airfoil profile and can comprise a set of points relative to the axis of rotation of the engine. For example, a set of points can be provided to define a rotor blade airfoil profile.

Figure 8:
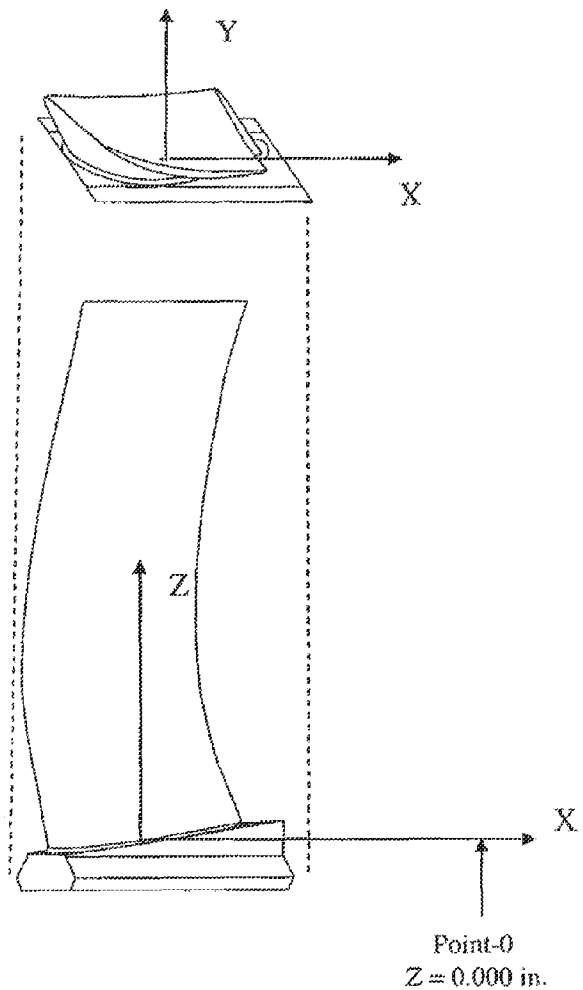
FIG. 8 is a perspective view of a stator blade according to an exemplary embodiment of the invention with coordinate system superimposed thereon.
Figure 7:
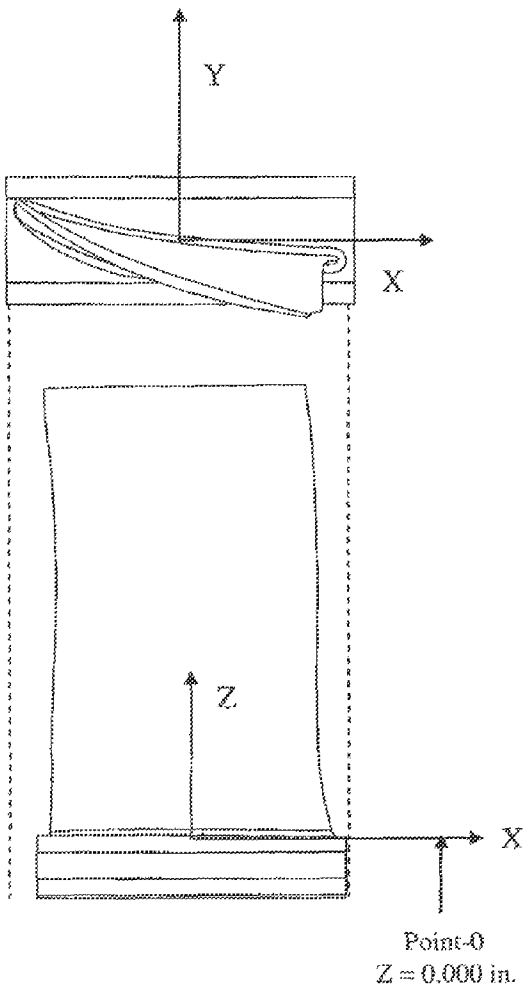
FIG. 7 is a perspective views of a rotor blade according to an exemplary embodiment of the invention with coordinate system superimposed thereon.

A Cartesian coordinate system of X, Y and Z values given in the Table below defines a profile of a rotor blade airfoil at various locations along its length. The airfoil, as embodied by the invention, could find an application as a 3$^{rd}$ stage airfoil variable stator blade. The coordinate values for the X, Y and Z coordinates are set forth in inches, although other units of dimensions may be used when the values are appropriately converted. These values exclude fillet regions of the platform. The Cartesian coordinate system has orthogonally-related X, Y and Z axes. The X axis lies parallel to the compressor blade's dovetail axis, which is at a angle to the engine's centerline, as illustrated in FIG. 7 for a rotor and FIG. 8 for a stator. A positive X coordinate value is axial toward the aft, for example the exhaust end of the compressor. A positive Y coordinate value directed normal to the dovetail axis. A positive Z coordinate value is directed radially outward toward tip of the airfoil, which is towards the static casing of the compressor for rotor blades, and directed radially inward towards the engine centerline of the compressor for stator blades.

Figure 5:
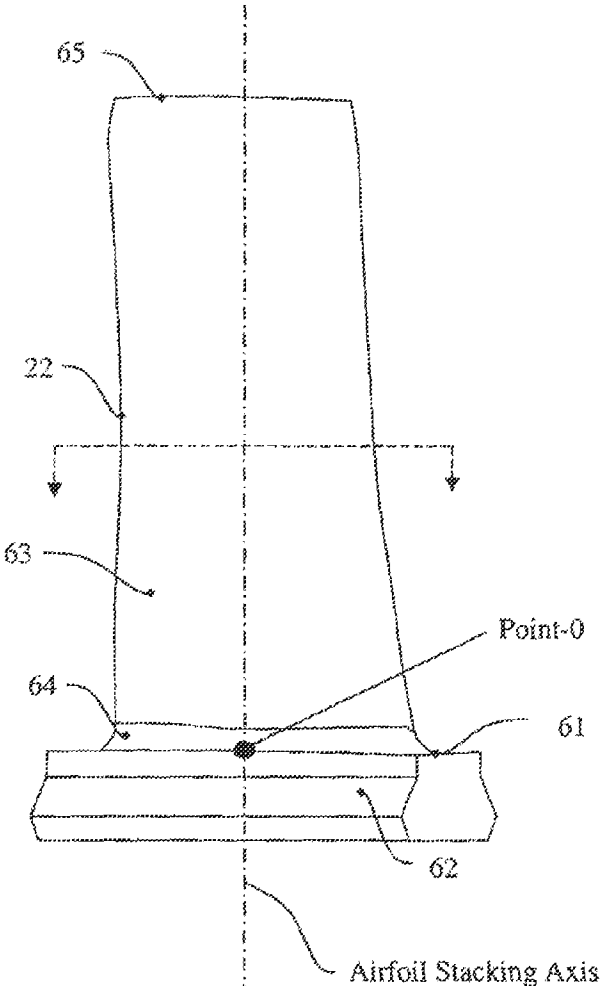

For reference purposes only, there is established point-0 passing through the intersection of the airfoil and the platform along the stacking axis, as illustrated in FIG. 5. In the exemplary embodiment of the airfoil hereof, the point-0 is defined as the reference section where Z coordinate of the table above is at 0.000 inches, which is a set predetermined distance from the engine or rotor centerline.

By defining X and Y coordinate values at selected locations in a Z direction normal to the X, Y plane, the profile section of the rotor blade airfoil, such as, but not limited to the profile section 66 in FIG. 6, at each Z distance along the length of the airfoil can be ascertained. By connecting the X and Y values with smooth continuing arcs, each profile section 66 at each distance Z can be fixed. The airfoil profiles of the various surface locations between the distances Z are determined by smoothly connecting the adjacent profile sections 66 to one another, thus forming the airfoil profile. These values represent the airfoil profiles at ambient, non-operating or non-hot conditions and are for an uncoated airfoil.

The table values are generated and shown to three decimal places for determining the profile of the airfoil. There are typical manufacturing tolerances as well as coatings, which should be accounted for in the actual profile of the airfoil. Accordingly, the values for the profile given are for a nominal airfoil. It will therefore be appreciated that +/− typical manufacturing tolerances, such as, +/− values, including any coating thicknesses, are additive to the X and Y values. Therefore, a distance of about +/− 0.160 inches in a direction normal to any surface location along the airfoil profile defines an range of variation between measured points on the actual airfoil surface at nominal cold or room temperature and the ideal position of those points, at the same temperature, as embodied by the invention. The rotor blade airfoil design, as embodied by the invention, is robust to this range of variation without impairment of mechanical and aerodynamic functions.

The coordinate values given in TABLE 1 below provide the nominal profile envelope for an exemplary 3$^{rd}$ stage airfoil variable stator blade.

TABLE I

| X-LOC | Y-LOC | Z-LOC |
|---|---|---|
| 2.08 | −2.026 | 0.005 |
| 2.079 | −2.028 | 0.005 |
| 2.077 | −2.032 | 0.005 |
| 2.071 | −2.039 | 0.005 |
| 2.06 | −2.046 | 0.005 |
| 2.036 | −2.047 | 0.005 |
| 2.005 | −2.038 | 0.005 |
| 1.964 | −2.024 | 0.005 |
| 1.913 | −2.007 | 0.005 |
| 1.846 | −1.985 | 0.005 |
| 1.77 | −1.958 | 0.005 |
| 1.688 | −1.93 | 0.005 |
| 1.596 | −1.897 | 0.005 |
| 1.495 | −1.86 | 0.005 |
| 1.384 | −1.819 | 0.005 |
| 1.268 | −1.774 | 0.005 |
| 1.147 | −1.726 | 0.005 |
| 1.023 | −1.674 | 0.005 |
| 0.893 | −1.62 | 0.005 |
| 0.76 | −1.561 | 0.005 |
| 0.623 | −1.498 | 0.005 |
| 0.482 | −1.43 | 0.005 |
| 0.337 | −1.357 | 0.005 |
| 0.194 | −1.281 | 0.005 |
| 0.053 | −1.203 | 0.005 |
| −0.087 | −1.121 | 0.005 |
| −0.224 | −1.037 | 0.005 |
| −0.36 | −0.948 | 0.005 |
| −0.494 | −0.856 | 0.005 |
| −0.625 | −0.761 | 0.005 |
| −0.753 | −0.662 | 0.005 |
| −0.878 | −0.559 | 0.005 |
| −1 | −0.452 | 0.005 |
| −1.119 | −0.342 | 0.005 |
| −1.231 | −0.232 | 0.005 |
| −1.335 | −0.123 | 0.005 |
| −1.432 | −0.015 | 0.005 |
| −1.522 | 0.092 | 0.005 |
| −1.605 | 0.197 | 0.005 |
| −1.683 | 0.3 | 0.005 |
| −1.754 | 0.4 | 0.005 |
| −1.816 | 0.495 | 0.005 |
| −1.87 | 0.582 | 0.005 |
| −1.915 | 0.661 | 0.005 |
| −1.954 | 0.733 | 0.005 |
| −1.985 | 0.796 | 0.005 |
| −2.009 | 0.851 | 0.005 |
| −2.029 | 0.898 | 0.005 |
| −2.044 | 0.938 | 0.005 |

TABLE I-continued

| X-LOC | Y-LOC | Z-LOC |
|---|---|---|
| −2.055 | 0.971 | 0.005 |
| −2.061 | 0.999 | 0.005 |
| −2.063 | 1.02 | 0.005 |
| −2.063 | 1.037 | 0.005 |
| −2.061 | 1.05 | 0.005 |
| −2.057 | 1.06 | 0.005 |
| −2.051 | 1.066 | 0.005 |
| −2.044 | 1.07 | 0.005 |
| −2.034 | 1.071 | 0.005 |
| −2.021 | 1.07 | 0.005 |
| −2.006 | 1.066 | 0.005 |
| −1.987 | 1.057 | 0.005 |
| −1.963 | 1.045 | 0.005 |
| −1.934 | 1.026 | 0.005 |
| −1.901 | 1.002 | 0.005 |
| −1.863 | 0.972 | 0.005 |
| −1.818 | 0.937 | 0.005 |
| −1.766 | 0.894 | 0.005 |
| −1.707 | 0.843 | 0.005 |
| −1.64 | 0.785 | 0.005 |
| −1.566 | 0.719 | 0.005 |
| −1.485 | 0.646 | 0.005 |
| −1.396 | 0.566 | 0.005 |
| −1.303 | 0.483 | 0.005 |
| −1.207 | 0.396 | 0.005 |
| −1.106 | 0.306 | 0.005 |
| −1.001 | 0.213 | 0.005 |
| −0.892 | 0.117 | 0.005 |
| −0.779 | 0.017 | 0.005 |
| −0.661 | −0.085 | 0.005 |
| −0.542 | −0.186 | 0.005 |
| −0.422 | −0.285 | 0.005 |
| −0.301 | −0.383 | 0.005 |
| −0.179 | −0.48 | 0.005 |
| −0.056 | −0.576 | 0.005 |
| 0.068 | −0.671 | 0.005 |
| 0.192 | −0.765 | 0.005 |
| 0.317 | −0.858 | 0.005 |
| 0.443 | −0.95 | 0.005 |
| 0.57 | −1.041 | 0.005 |
| 0.697 | −1.131 | 0.005 |
| 0.821 | −1.216 | 0.005 |
| 0.942 | −1.298 | 0.005 |
| 1.059 | −1.376 | 0.005 |
| 1.172 | −1.449 | 0.005 |
| 1.282 | −1.519 | 0.005 |
| 1.388 | −1.585 | 0.005 |
| 1.49 | −1.647 | 0.005 |
| 1.588 | −1.706 | 0.005 |
| 1.678 | −1.759 | 0.005 |
| 1.759 | −1.806 | 0.005 |
| 1.831 | −1.847 | 0.005 |
| 1.899 | −1.886 | 0.005 |
| 1.958 | −1.918 | 0.005 |
| 2.003 | −1.944 | 0.005 |
| 2.04 | −1.964 | 0.005 |
| 2.067 | −1.979 | 0.005 |
| 2.081 | −1.997 | 0.005 |
| 2.083 | −2.01 | 0.005 |
| 2.082 | −2.018 | 0.005 |
| 2.081 | −2.022 | 0.005 |
| 2.08 | −2.024 | 0.005 |
| 2.08 | −2.025 | 0.005 |
| 2.198 | −1.391 | 1.544 |
| 2.197 | −1.392 | 1.544 |
| 2.195 | −1.396 | 1.544 |
| 2.19 | −1.402 | 1.544 |
| 2.179 | −1.409 | 1.544 |
| 2.156 | −1.41 | 1.544 |
| 2.126 | −1.402 | 1.544 |
| 2.087 | −1.39 | 1.544 |
| 2.038 | −1.375 | 1.544 |
| 1.974 | −1.355 | 1.544 |
| 1.9 | −1.332 | 1.544 |
| 1.822 | −1.307 | 1.544 |
| 1.734 | −1.279 | 1.544 |
| 1.636 | −1.248 | 1.544 |

TABLE I-continued

| X-LOC | Y-LOC | Z-LOC |
|---|---|---|
| 1.528 | −1.212 | 1.544 |
| 1.416 | −1.175 | 1.544 |
| 1.3 | −1.134 | 1.544 |
| 1.178 | −1.092 | 1.544 |
| 1.053 | −1.047 | 1.544 |
| 0.922 | −0.999 | 1.544 |
| 0.788 | −0.948 | 1.544 |
| 0.649 | −0.893 | 1.544 |
| 0.506 | −0.835 | 1.544 |
| 0.364 | −0.775 | 1.544 |
| 0.223 | −0.713 | 1.544 |
| 0.083 | −0.649 | 1.544 |
| −0.056 | −0.582 | 1.544 |
| −0.194 | −0.513 | 1.544 |
| −0.33 | −0.441 | 1.544 |
| −0.465 | −0.366 | 1.544 |
| −0.597 | −0.287 | 1.544 |
| −0.728 | −0.206 | 1.544 |
| −0.857 | −0.121 | 1.544 |
| −0.983 | −0.032 | 1.544 |
| −1.103 | 0.056 | 1.544 |
| −1.215 | 0.145 | 1.544 |
| −1.32 | 0.234 | 1.544 |
| −1.419 | 0.323 | 1.544 |
| −1.512 | 0.411 | 1.544 |
| −1.598 | 0.498 | 1.544 |
| −1.678 | 0.584 | 1.544 |
| −1.748 | 0.665 | 1.544 |
| −1.81 | 0.74 | 1.544 |
| −1.863 | 0.81 | 1.544 |
| −1.908 | 0.873 | 1.544 |
| −1.945 | 0.929 | 1.544 |
| −1.975 | 0.977 | 1.544 |
| −1.998 | 1.019 | 1.544 |
| −2.017 | 1.055 | 1.544 |
| −2.031 | 1.086 | 1.544 |
| −2.04 | 1.111 | 1.544 |
| −2.044 | 1.131 | 1.544 |
| −2.046 | 1.147 | 1.544 |
| −2.045 | 1.16 | 1.544 |
| −2.042 | 1.17 | 1.544 |
| −2.037 | 1.176 | 1.544 |
| −2.031 | 1.18 | 1.544 |
| −2.022 | 1.183 | 1.544 |
| −2.009 | 1.184 | 1.544 |
| −1.994 | 1.182 | 1.544 |
| −1.975 | 1.178 | 1.544 |
| −1.95 | 1.17 | 1.544 |
| −1.921 | 1.157 | 1.544 |
| −1.886 | 1.139 | 1.544 |
| −1.844 | 1.117 | 1.544 |
| −1.796 | 1.09 | 1.544 |
| −1.74 | 1.058 | 1.544 |
| −1.677 | 1.019 | 1.544 |
| −1.605 | 0.973 | 1.544 |
| −1.525 | 0.922 | 1.544 |
| −1.438 | 0.865 | 1.544 |
| −1.342 | 0.802 | 1.544 |
| −1.242 | 0.736 | 1.544 |
| −1.138 | 0.668 | 1.544 |
| −1.03 | 0.596 | 1.544 |
| −0.918 | 0.522 | 1.544 |
| −0.801 | 0.445 | 1.544 |
| −0.681 | 0.365 | 1.544 |
| −0.556 | 0.283 | 1.544 |
| −0.431 | 0.201 | 1.544 |
| −0.305 | 0.12 | 1.544 |
| −0.179 | 0.04 | 1.544 |
| −0.053 | −0.04 | 1.544 |
| 0.074 | −0.12 | 1.544 |
| 0.2 | −0.199 | 1.544 |
| 0.327 | −0.279 | 1.544 |
| 0.454 | −0.358 | 1.544 |
| 0.581 | −0.436 | 1.544 |
| 0.708 | −0.514 | 1.544 |
| 0.836 | −0.591 | 1.544 |
| 0.961 | −0.665 | 1.544 |

TABLE I-continued

| X-LOC | Y-LOC | Z-LOC |
|---|---|---|
| 1.081 | −0.736 | 1.544 |
| 1.197 | −0.804 | 1.544 |
| 1.309 | −0.869 | 1.544 |
| 1.418 | −0.93 | 1.544 |
| 1.522 | −0.988 | 1.544 |
| 1.622 | −1.044 | 1.544 |
| 1.718 | −1.097 | 1.544 |
| 1.806 | −1.145 | 1.544 |
| 1.885 | −1.187 | 1.544 |
| 1.955 | −1.225 | 1.544 |
| 2.021 | −1.26 | 1.544 |
| 2.078 | −1.29 | 1.544 |
| 2.122 | −1.313 | 1.544 |
| 2.158 | −1.332 | 1.544 |
| 2.184 | −1.346 | 1.544 |
| 2.198 | −1.363 | 1.544 |
| 2.201 | −1.375 | 1.544 |
| 2.2 | −1.383 | 1.544 |
| 2.199 | −1.387 | 1.544 |
| 2.199 | −1.389 | 1.544 |
| 2.198 | −1.39 | 1.544 |
| 2.118 | −0.761 | 3.082 |
| 2.117 | −0.763 | 3.082 |
| 2.116 | −0.767 | 3.082 |
| 2.111 | −0.773 | 3.082 |
| 2.1 | −0.78 | 3.082 |
| 2.078 | −0.782 | 3.082 |
| 2.05 | −0.774 | 3.082 |
| 2.012 | −0.764 | 3.082 |
| 1.964 | −0.751 | 3.082 |
| 1.902 | −0.735 | 3.082 |
| 1.831 | −0.715 | 3.082 |
| 1.756 | −0.694 | 3.082 |
| 1.67 | −0.669 | 3.082 |
| 1.576 | −0.642 | 3.082 |
| 1.472 | −0.612 | 3.082 |
| 1.364 | −0.58 | 3.082 |
| 1.251 | −0.546 | 3.082 |
| 1.133 | −0.509 | 3.082 |
| 1.011 | −0.47 | 3.082 |
| 0.885 | −0.429 | 3.082 |
| 0.755 | −0.385 | 3.082 |
| 0.62 | −0.339 | 3.082 |
| 0.481 | −0.288 | 3.082 |
| 0.343 | −0.236 | 3.082 |
| 0.206 | −0.182 | 3.082 |
| 0.069 | −0.126 | 3.082 |
| −0.066 | −0.068 | 3.082 |
| −0.2 | −0.007 | 3.082 |
| −0.333 | 0.056 | 3.082 |
| −0.465 | 0.123 | 3.082 |
| −0.595 | 0.192 | 3.082 |
| −0.724 | 0.265 | 3.082 |
| −0.85 | 0.341 | 3.082 |
| −0.974 | 0.421 | 3.082 |
| −1.092 | 0.501 | 3.082 |
| −1.202 | 0.582 | 3.082 |
| −1.306 | 0.663 | 3.082 |
| −1.404 | 0.743 | 3.082 |
| −1.495 | 0.824 | 3.082 |
| −1.581 | 0.904 | 3.082 |
| −1.66 | 0.984 | 3.082 |
| −1.731 | 1.059 | 3.082 |
| −1.792 | 1.129 | 3.082 |
| −1.845 | 1.194 | 3.082 |
| −1.89 | 1.253 | 3.082 |
| −1.927 | 1.305 | 3.082 |
| −1.956 | 1.351 | 3.082 |
| −1.98 | 1.391 | 3.082 |
| −2 | 1.425 | 3.082 |
| −2.013 | 1.454 | 3.082 |
| −2.022 | 1.478 | 3.082 |
| −2.027 | 1.497 | 3.082 |
| −2.029 | 1.512 | 3.082 |
| −2.028 | 1.524 | 3.082 |
| −2.025 | 1.534 | 3.082 |
| −2.021 | 1.54 | 3.082 |

TABLE I-continued

| X-LOC | Y-LOC | Z-LOC |
|---|---|---|
| −2.015 | 1.544 | 3.082 |
| −2.006 | 1.547 | 3.082 |
| −1.995 | 1.549 | 3.082 |
| −1.98 | 1.548 | 3.082 |
| −1.962 | 1.544 | 3.082 |
| −1.938 | 1.537 | 3.082 |
| −1.909 | 1.526 | 3.082 |
| −1.875 | 1.511 | 3.082 |
| −1.834 | 1.491 | 3.082 |
| −1.787 | 1.468 | 3.082 |
| −1.733 | 1.438 | 3.082 |
| −1.67 | 1.404 | 3.082 |
| −1.6 | 1.364 | 3.082 |
| −1.521 | 1.318 | 3.082 |
| −1.435 | 1.268 | 3.082 |
| −1.341 | 1.212 | 3.082 |
| −1.243 | 1.154 | 3.082 |
| −1.14 | 1.093 | 3.082 |
| −1.034 | 1.03 | 3.082 |
| −0.923 | 0.964 | 3.082 |
| −0.808 | 0.896 | 3.082 |
| −0.689 | 0.826 | 3.082 |
| −0.566 | 0.753 | 3.082 |
| −0.443 | 0.681 | 3.082 |
| −0.319 | 0.609 | 3.082 |
| −0.195 | 0.538 | 3.082 |
| −0.071 | 0.466 | 3.082 |
| 0.053 | 0.395 | 3.082 |
| 0.176 | 0.323 | 3.082 |
| 0.3 | 0.252 | 3.082 |
| 0.424 | 0.181 | 3.082 |
| 0.548 | 0.11 | 3.082 |
| 0.673 | 0.039 | 3.082 |
| 0.797 | −0.031 | 3.082 |
| 0.918 | −0.098 | 3.082 |
| 1.035 | −0.162 | 3.082 |
| 1.148 | −0.224 | 3.082 |
| 1.257 | −0.283 | 3.082 |
| 1.362 | −0.339 | 3.082 |
| 1.463 | −0.392 | 3.082 |
| 1.56 | −0.443 | 3.082 |
| 1.653 | −0.491 | 3.082 |
| 1.738 | −0.535 | 3.082 |
| 1.815 | −0.574 | 3.082 |
| 1.883 | −0.608 | 3.082 |
| 1.947 | −0.64 | 3.082 |
| 2.002 | −0.668 | 3.082 |
| 2.045 | −0.689 | 3.082 |
| 2.079 | −0.706 | 3.082 |
| 2.104 | −0.719 | 3.082 |
| 2.118 | −0.735 | 3.082 |
| 2.121 | −0.746 | 3.082 |
| 2.12 | −0.754 | 3.082 |
| 2.119 | −0.758 | 3.082 |
| 2.119 | −0.759 | 3.082 |
| 2.119 | −0.76 | 3.082 |
| 2.082 | −0.346 | 4.621 |
| 2.081 | −0.348 | 4.621 |
| 2.079 | −0.352 | 4.621 |
| 2.074 | −0.358 | 4.621 |
| 2.064 | −0.365 | 4.621 |
| 2.043 | −0.366 | 4.621 |
| 2.015 | −0.36 | 4.621 |
| 1.978 | −0.351 | 4.621 |
| 1.931 | −0.34 | 4.621 |
| 1.87 | −0.326 | 4.621 |
| 1.8 | −0.309 | 4.621 |
| 1.726 | −0.29 | 4.621 |
| 1.642 | −0.269 | 4.621 |
| 1.549 | −0.246 | 4.621 |
| 1.447 | −0.22 | 4.621 |
| 1.34 | −0.191 | 4.621 |
| 1.229 | −0.161 | 4.621 |
| 1.114 | −0.129 | 4.621 |
| 0.994 | −0.094 | 4.621 |
| 0.87 | −0.058 | 4.621 |
| 0.742 | −0.018 | 4.621 |

TABLE I-continued

| X-LOC | Y-LOC | Z-LOC |
|---|---|---|
| 0.609 | 0.024 | 4.621 |
| 0.473 | 0.07 | 4.621 |
| 0.337 | 0.117 | 4.621 |
| 0.202 | 0.166 | 4.621 |
| 0.067 | 0.218 | 4.621 |
| −0.066 | 0.272 | 4.621 |
| −0.198 | 0.328 | 4.621 |
| −0.329 | 0.387 | 4.621 |
| −0.459 | 0.449 | 4.621 |
| −0.587 | 0.514 | 4.621 |
| −0.714 | 0.583 | 4.621 |
| −0.838 | 0.654 | 4.621 |
| −0.961 | 0.73 | 4.621 |
| −1.077 | 0.806 | 4.621 |
| −1.186 | 0.883 | 4.621 |
| −1.289 | 0.96 | 4.621 |
| −1.385 | 1.038 | 4.621 |
| −1.476 | 1.114 | 4.621 |
| −1.56 | 1.191 | 4.621 |
| −1.64 | 1.267 | 4.621 |
| −1.71 | 1.339 | 4.621 |
| −1.771 | 1.406 | 4.621 |
| −1.824 | 1.469 | 4.621 |
| −1.869 | 1.525 | 4.621 |
| −1.906 | 1.575 | 4.621 |
| −1.936 | 1.619 | 4.621 |
| −1.96 | 1.657 | 4.621 |
| −1.979 | 1.69 | 4.621 |
| −1.993 | 1.718 | 4.621 |
| −2.002 | 1.742 | 4.621 |
| −2.007 | 1.76 | 4.621 |
| −2.009 | 1.775 | 4.621 |
| −2.009 | 1.787 | 4.621 |
| −2.006 | 1.796 | 4.621 |
| −2.002 | 1.802 | 4.621 |
| −1.997 | 1.806 | 4.621 |
| −1.988 | 1.81 | 4.621 |
| −1.976 | 1.811 | 4.621 |
| −1.963 | 1.81 | 4.621 |
| −1.944 | 1.807 | 4.621 |
| −1.921 | 1.801 | 4.621 |
| −1.893 | 1.79 | 4.621 |
| −1.859 | 1.775 | 4.621 |
| −1.82 | 1.757 | 4.621 |
| −1.774 | 1.734 | 4.621 |
| −1.72 | 1.707 | 4.621 |
| −1.659 | 1.674 | 4.621 |
| −1.59 | 1.636 | 4.621 |
| −1.513 | 1.593 | 4.621 |
| −1.428 | 1.545 | 4.621 |
| −1.335 | 1.492 | 4.621 |
| −1.238 | 1.437 | 4.621 |
| −1.137 | 1.38 | 4.621 |
| −1.032 | 1.321 | 4.621 |
| −0.922 | 1.259 | 4.621 |
| −0.809 | 1.196 | 4.621 |
| −0.691 | 1.131 | 4.621 |
| −0.57 | 1.063 | 4.621 |
| −0.448 | 0.996 | 4.621 |
| −0.325 | 0.929 | 4.621 |
| −0.203 | 0.863 | 4.621 |
| −0.081 | 0.796 | 4.621 |
| 0.042 | 0.73 | 4.621 |
| 0.164 | 0.663 | 4.621 |
| 0.286 | 0.596 | 4.621 |
| 0.409 | 0.53 | 4.621 |
| 0.531 | 0.464 | 4.621 |
| 0.654 | 0.398 | 4.621 |
| 0.777 | 0.333 | 4.621 |
| 0.896 | 0.27 | 4.621 |
| 1.011 | 0.21 | 4.621 |
| 1.123 | 0.152 | 4.621 |
| 1.23 | 0.098 | 4.621 |
| 1.334 | 0.046 | 4.621 |
| 1.434 | −0.004 | 4.621 |
| 1.53 | −0.051 | 4.621 |
| 1.621 | −0.096 | 4.621 |

TABLE I-continued

| X-LOC | Y-LOC | Z-LOC |
|---|---|---|
| 1.705 | −0.136 | 4.621 |
| 1.78 | −0.172 | 4.621 |
| 1.848 | −0.204 | 4.621 |
| 1.911 | −0.233 | 4.621 |
| 1.965 | −0.259 | 4.621 |
| 2.007 | −0.279 | 4.621 |
| 2.041 | −0.294 | 4.621 |
| 2.066 | −0.306 | 4.621 |
| 2.081 | −0.321 | 4.621 |
| 2.084 | −0.332 | 4.621 |
| 2.084 | −0.339 | 4.621 |
| 2.083 | −0.343 | 4.621 |
| 2.082 | −0.345 | 4.621 |
| 2.082 | −0.345 | 4.621 |
| 2.102 | −0.168 | 6.16 |
| 2.101 | −0.17 | 6.16 |
| 2.1 | −0.174 | 6.16 |
| 2.095 | −0.18 | 6.16 |
| 2.085 | −0.187 | 6.16 |
| 2.064 | −0.188 | 6.16 |
| 2.036 | −0.183 | 6.16 |
| 1.999 | −0.175 | 6.16 |
| 1.952 | −0.165 | 6.16 |
| 1.891 | −0.153 | 6.16 |
| 1.822 | −0.138 | 6.16 |
| 1.747 | −0.121 | 6.16 |
| 1.664 | −0.103 | 6.16 |
| 1.571 | −0.082 | 6.16 |
| 1.469 | −0.058 | 6.16 |
| 1.362 | −0.033 | 6.16 |
| 1.251 | −0.006 | 6.16 |
| 1.136 | 0.023 | 6.16 |
| 1.017 | 0.055 | 6.16 |
| 0.893 | 0.089 | 6.16 |
| 0.765 | 0.125 | 6.16 |
| 0.632 | 0.165 | 6.16 |
| 0.496 | 0.207 | 6.16 |
| 0.361 | 0.252 | 6.16 |
| 0.226 | 0.298 | 6.16 |
| 0.092 | 0.347 | 6.16 |
| −0.041 | 0.399 | 6.16 |
| −0.173 | 0.453 | 6.16 |
| −0.304 | 0.51 | 6.16 |
| −0.434 | 0.57 | 6.16 |
| −0.561 | 0.634 | 6.16 |
| −0.688 | 0.7 | 6.16 |
| −0.812 | 0.771 | 6.16 |
| −0.933 | 0.845 | 6.16 |
| −1.049 | 0.92 | 6.16 |
| −1.158 | 0.996 | 6.16 |
| −1.261 | 1.072 | 6.16 |
| −1.357 | 1.148 | 6.16 |
| −1.448 | 1.224 | 6.16 |
| −1.532 | 1.299 | 6.16 |
| −1.611 | 1.374 | 6.16 |
| −1.682 | 1.444 | 6.16 |
| −1.743 | 1.51 | 6.16 |
| −1.797 | 1.571 | 6.16 |
| −1.842 | 1.626 | 6.16 |
| −1.88 | 1.676 | 6.16 |
| −1.91 | 1.718 | 6.16 |
| −1.935 | 1.756 | 6.16 |
| −1.955 | 1.788 | 6.16 |
| −1.969 | 1.815 | 6.16 |
| −1.979 | 1.838 | 6.16 |
| −1.984 | 1.856 | 6.16 |
| −1.987 | 1.871 | 6.16 |
| −1.987 | 1.883 | 6.16 |
| −1.985 | 1.892 | 6.16 |
| −1.981 | 1.898 | 6.16 |
| −1.976 | 1.902 | 6.16 |
| −1.967 | 1.905 | 6.16 |
| −1.956 | 1.906 | 6.16 |
| −1.942 | 1.905 | 6.16 |
| −1.924 | 1.901 | 6.16 |
| −1.901 | 1.894 | 6.16 |
| −1.873 | 1.883 | 6.16 |

TABLE I-continued

| X-LOC | Y-LOC | Z-LOC |
|---|---|---|
| −1.84 | 1.868 | 6.16 |
| −1.801 | 1.849 | 6.16 |
| −1.756 | 1.826 | 6.16 |
| −1.703 | 1.798 | 6.16 |
| −1.643 | 1.765 | 6.16 |
| −1.575 | 1.726 | 6.16 |
| −1.499 | 1.683 | 6.16 |
| −1.415 | 1.635 | 6.16 |
| −1.323 | 1.583 | 6.16 |
| −1.227 | 1.528 | 6.16 |
| −1.126 | 1.472 | 6.16 |
| −1.022 | 1.413 | 6.16 |
| −0.913 | 1.353 | 6.16 |
| −0.801 | 1.291 | 6.16 |
| −0.683 | 1.227 | 6.16 |
| −0.562 | 1.162 | 6.16 |
| −0.44 | 1.097 | 6.16 |
| −0.318 | 1.032 | 6.16 |
| −0.195 | 0.968 | 6.16 |
| −0.073 | 0.905 | 6.16 |
| 0.05 | 0.841 | 6.16 |
| 0.172 | 0.778 | 6.16 |
| 0.295 | 0.714 | 6.16 |
| 0.418 | 0.651 | 6.16 |
| 0.541 | 0.589 | 6.16 |
| 0.664 | 0.527 | 6.16 |
| 0.788 | 0.465 | 6.16 |
| 0.907 | 0.406 | 6.16 |
| 1.023 | 0.35 | 6.16 |
| 1.135 | 0.296 | 6.16 |
| 1.244 | 0.245 | 6.16 |
| 1.348 | 0.196 | 6.16 |
| 1.448 | 0.15 | 6.16 |
| 1.544 | 0.106 | 6.16 |
| 1.637 | 0.064 | 6.16 |
| 1.721 | 0.027 | 6.16 |
| 1.797 | −0.006 | 6.16 |
| 1.864 | −0.036 | 6.16 |
| 1.928 | −0.063 | 6.16 |
| 1.983 | −0.086 | 6.16 |
| 2.025 | −0.104 | 6.16 |
| 2.059 | −0.119 | 6.16 |
| 2.084 | −0.13 | 6.16 |
| 2.1 | −0.143 | 6.16 |
| 2.103 | −0.154 | 6.16 |
| 2.104 | −0.161 | 6.16 |
| 2.103 | −0.165 | 6.16 |
| 2.103 | −0.167 | 6.16 |
| 2.102 | −0.168 | 6.16 |
| 2.121 | −0.233 | 7.698 |
| 2.12 | −0.235 | 7.698 |
| 2.119 | −0.238 | 7.698 |
| 2.114 | −0.245 | 7.698 |
| 2.104 | −0.252 | 7.698 |
| 2.083 | −0.253 | 7.698 |
| 2.056 | −0.248 | 7.698 |
| 2.018 | −0.241 | 7.698 |
| 1.972 | −0.233 | 7.698 |
| 1.912 | −0.221 | 7.698 |
| 1.842 | −0.208 | 7.698 |
| 1.768 | −0.194 | 7.698 |
| 1.684 | −0.177 | 7.698 |
| 1.592 | −0.159 | 7.698 |
| 1.49 | −0.138 | 7.698 |
| 1.383 | −0.116 | 7.698 |
| 1.273 | −0.091 | 7.698 |
| 1.158 | −0.065 | 7.698 |
| 1.038 | −0.036 | 7.698 |
| 0.915 | −0.006 | 7.698 |
| 0.787 | 0.028 | 7.698 |
| 0.655 | 0.064 | 7.698 |
| 0.519 | 0.104 | 7.698 |
| 0.383 | 0.145 | 7.698 |
| 0.249 | 0.189 | 7.698 |
| 0.115 | 0.235 | 7.698 |
| −0.018 | 0.284 | 7.698 |
| −0.149 | 0.337 | 7.698 |

TABLE I-continued

| X-LOC | Y-LOC | Z-LOC |
|---|---|---|
| −0.28 | 0.392 | 7.698 |
| −0.409 | 0.451 | 7.698 |
| −0.536 | 0.513 | 7.698 |
| −0.662 | 0.578 | 7.698 |
| −0.785 | 0.648 | 7.698 |
| −0.907 | 0.721 | 7.698 |
| −1.022 | 0.796 | 7.698 |
| −1.13 | 0.871 | 7.698 |
| −1.233 | 0.946 | 7.698 |
| −1.329 | 1.021 | 7.698 |
| −1.419 | 1.096 | 7.698 |
| −1.504 | 1.171 | 7.698 |
| −1.583 | 1.244 | 7.698 |
| −1.653 | 1.314 | 7.698 |
| −1.714 | 1.379 | 7.698 |
| −1.768 | 1.439 | 7.698 |
| −1.814 | 1.493 | 7.698 |
| −1.852 | 1.542 | 7.698 |
| −1.882 | 1.584 | 7.698 |
| −1.908 | 1.621 | 7.698 |
| −1.928 | 1.652 | 7.698 |
| −1.943 | 1.679 | 7.698 |
| −1.954 | 1.701 | 7.698 |
| −1.96 | 1.719 | 7.698 |
| −1.963 | 1.733 | 7.698 |
| −1.964 | 1.745 | 7.698 |
| −1.962 | 1.754 | 7.698 |
| −1.959 | 1.761 | 7.698 |
| −1.953 | 1.765 | 7.698 |
| −1.944 | 1.767 | 7.698 |
| −1.933 | 1.767 | 7.698 |
| −1.92 | 1.765 | 7.698 |
| −1.902 | 1.761 | 7.698 |
| −1.879 | 1.753 | 7.698 |
| −1.852 | 1.741 | 7.698 |
| −1.82 | 1.725 | 7.698 |
| −1.782 | 1.705 | 7.698 |
| −1.738 | 1.681 | 7.698 |
| −1.686 | 1.652 | 7.698 |
| −1.627 | 1.618 | 7.698 |
| −1.56 | 1.578 | 7.698 |
| −1.485 | 1.535 | 7.698 |
| −1.402 | 1.486 | 7.698 |
| −1.312 | 1.433 | 7.698 |
| −1.217 | 1.378 | 7.698 |
| −1.118 | 1.321 | 7.698 |
| −1.014 | 1.262 | 7.698 |
| −0.907 | 1.202 | 7.698 |
| −0.795 | 1.141 | 7.698 |
| −0.678 | 1.078 | 7.698 |
| −0.557 | 1.014 | 7.698 |
| −0.435 | 0.951 | 7.698 |
| −0.313 | 0.889 | 7.698 |
| −0.191 | 0.827 | 7.698 |
| −0.068 | 0.766 | 7.698 |
| 0.055 | 0.705 | 7.698 |
| 0.178 | 0.645 | 7.698 |
| 0.301 | 0.585 | 7.698 |
| 0.424 | 0.526 | 7.698 |
| 0.548 | 0.467 | 7.698 |
| 0.672 | 0.409 | 7.698 |
| 0.796 | 0.351 | 7.698 |
| 0.917 | 0.296 | 7.698 |
| 1.033 | 0.244 | 7.698 |
| 1.146 | 0.194 | 7.698 |
| 1.255 | 0.147 | 7.698 |
| 1.36 | 0.102 | 7.698 |
| 1.461 | 0.06 | 7.698 |
| 1.558 | 0.019 | 7.698 |
| 1.651 | −0.019 | 7.698 |
| 1.735 | −0.053 | 7.698 |
| 1.812 | −0.083 | 7.698 |
| 1.88 | −0.11 | 7.698 |
| 1.944 | −0.135 | 7.698 |
| 1.999 | −0.157 | 7.698 |
| 2.042 | −0.173 | 7.698 |
| 2.076 | −0.186 | 7.698 |

TABLE I-continued

| X-LOC | Y-LOC | Z-LOC |
|---|---|---|
| 2.101 | −0.196 | 7.698 |
| 2.117 | −0.208 | 7.698 |
| 2.122 | −0.219 | 7.698 |
| 2.122 | −0.226 | 7.698 |
| 2.122 | −0.23 | 7.698 |
| 2.121 | −0.231 | 7.698 |
| 2.121 | −0.232 | 7.698 |
| 2.084 | −0.467 | 9.237 |
| 2.083 | −0.469 | 9.237 |
| 2.081 | −0.472 | 9.237 |
| 2.077 | −0.479 | 9.237 |
| 2.067 | −0.485 | 9.237 |
| 2.047 | −0.486 | 9.237 |
| 2.019 | −0.482 | 9.237 |
| 1.983 | −0.475 | 9.237 |
| 1.937 | −0.467 | 9.237 |
| 1.878 | −0.457 | 9.237 |
| 1.809 | −0.445 | 9.237 |
| 1.736 | −0.432 | 9.237 |
| 1.654 | −0.417 | 9.237 |
| 1.563 | −0.4 | 9.237 |
| 1.463 | −0.38 | 9.237 |
| 1.358 | −0.36 | 9.237 |
| 1.249 | −0.337 | 9.237 |
| 1.136 | −0.312 | 9.237 |
| 1.018 | −0.286 | 9.237 |
| 0.896 | −0.257 | 9.237 |
| 0.77 | −0.226 | 9.237 |
| 0.64 | −0.191 | 9.237 |
| 0.506 | −0.154 | 9.237 |
| 0.373 | −0.115 | 9.237 |
| 0.24 | −0.073 | 9.237 |
| 0.108 | −0.029 | 9.237 |
| −0.023 | 0.019 | 9.237 |
| −0.152 | 0.069 | 9.237 |
| −0.28 | 0.123 | 9.237 |
| −0.407 | 0.18 | 9.237 |
| −0.532 | 0.241 | 9.237 |
| −0.655 | 0.306 | 9.237 |
| −0.776 | 0.374 | 9.237 |
| −0.895 | 0.446 | 9.237 |
| −1.007 | 0.519 | 9.237 |
| −1.114 | 0.593 | 9.237 |
| −1.215 | 0.667 | 9.237 |
| −1.31 | 0.741 | 9.237 |
| −1.399 | 0.815 | 9.237 |
| −1.482 | 0.888 | 9.237 |
| −1.559 | 0.961 | 9.237 |
| −1.628 | 1.029 | 9.237 |
| −1.689 | 1.093 | 9.237 |
| −1.741 | 1.151 | 9.237 |
| −1.786 | 1.204 | 9.237 |
| −1.824 | 1.252 | 9.237 |
| −1.855 | 1.293 | 9.237 |
| −1.88 | 1.328 | 9.237 |
| −1.901 | 1.359 | 9.237 |
| −1.916 | 1.385 | 9.237 |
| −1.927 | 1.407 | 9.237 |
| −1.934 | 1.424 | 9.237 |
| −1.938 | 1.437 | 9.237 |
| −1.939 | 1.449 | 9.237 |
| −1.938 | 1.458 | 9.237 |
| −1.935 | 1.465 | 9.237 |
| −1.929 | 1.468 | 9.237 |
| −1.92 | 1.47 | 9.237 |
| −1.909 | 1.469 | 9.237 |
| −1.896 | 1.466 | 9.237 |
| −1.879 | 1.461 | 9.237 |
| −1.857 | 1.452 | 9.237 |
| −1.831 | 1.44 | 9.237 |
| −1.8 | 1.422 | 9.237 |
| −1.764 | 1.401 | 9.237 |
| −1.721 | 1.376 | 9.237 |
| −1.671 | 1.346 | 9.237 |
| −1.614 | 1.311 | 9.237 |
| −1.549 | 1.271 | 9.237 |
| −1.476 | 1.226 | 9.237 |

TABLE I-continued

| X-LOC | Y-LOC | Z-LOC |
|---|---|---|
| −1.396 | 1.177 | 9.237 |
| −1.308 | 1.123 | 9.237 |
| −1.216 | 1.067 | 9.237 |
| −1.119 | 1.01 | 9.237 |
| −1.018 | 0.952 | 9.237 |
| −0.913 | 0.892 | 9.237 |
| −0.803 | 0.831 | 9.237 |
| −0.689 | 0.769 | 9.237 |
| −0.57 | 0.706 | 9.237 |
| −0.45 | 0.644 | 9.237 |
| −0.33 | 0.584 | 9.237 |
| −0.21 | 0.524 | 9.237 |
| −0.089 | 0.465 | 9.237 |
| 0.033 | 0.407 | 9.237 |
| 0.154 | 0.35 | 9.237 |
| 0.276 | 0.293 | 9.237 |
| 0.399 | 0.237 | 9.237 |
| 0.522 | 0.182 | 9.237 |
| 0.645 | 0.128 | 9.237 |
| 0.768 | 0.074 | 9.237 |
| 0.887 | 0.023 | 9.237 |
| 1.003 | −0.026 | 9.237 |
| 1.115 | −0.072 | 9.237 |
| 1.223 | −0.116 | 9.237 |
| 1.327 | −0.157 | 9.237 |
| 1.428 | −0.196 | 9.237 |
| 1.524 | −0.233 | 9.237 |
| 1.616 | −0.268 | 9.237 |
| 1.7 | −0.3 | 9.237 |
| 1.776 | −0.328 | 9.237 |
| 1.843 | −0.353 | 9.237 |
| 1.907 | −0.376 | 9.237 |
| 1.961 | −0.395 | 9.237 |
| 2.004 | −0.41 | 9.237 |
| 2.038 | −0.423 | 9.237 |
| 2.063 | −0.432 | 9.237 |
| 2.079 | −0.443 | 9.237 |
| 2.084 | −0.453 | 9.237 |
| 2.085 | −0.46 | 9.237 |
| 2.084 | −0.464 | 9.237 |
| 2.084 | −0.465 | 9.237 |
| 2.084 | −0.466 | 9.237 |
| 2.048 | −0.807 | 10.776 |
| 2.048 | −0.809 | 10.776 |
| 2.046 | −0.813 | 10.776 |
| 2.042 | −0.819 | 10.776 |
| 2.032 | −0.825 | 10.776 |
| 2.012 | −0.825 | 10.776 |
| 1.985 | −0.82 | 10.776 |
| 1.949 | −0.813 | 10.776 |
| 1.904 | −0.805 | 10.776 |
| 1.845 | −0.794 | 10.776 |
| 1.778 | −0.782 | 10.776 |
| 1.706 | −0.768 | 10.776 |
| 1.625 | −0.753 | 10.776 |
| 1.536 | −0.735 | 10.776 |
| 1.437 | −0.715 | 10.776 |
| 1.334 | −0.694 | 10.776 |
| 1.227 | −0.67 | 10.776 |
| 1.115 | −0.645 | 10.776 |
| 1 | −0.618 | 10.776 |
| 0.88 | −0.589 | 10.776 |
| 0.756 | −0.557 | 10.776 |
| 0.628 | −0.523 | 10.776 |
| 0.496 | −0.485 | 10.776 |
| 0.365 | −0.445 | 10.776 |
| 0.235 | −0.403 | 10.776 |
| 0.105 | −0.358 | 10.776 |
| −0.023 | −0.31 | 10.776 |
| −0.15 | −0.26 | 10.776 |
| −0.276 | −0.205 | 10.776 |
| −0.4 | −0.148 | 10.776 |
| −0.523 | −0.087 | 10.776 |
| −0.644 | −0.022 | 10.776 |
| −0.762 | 0.046 | 10.776 |
| −0.879 | 0.118 | 10.776 |
| −0.99 | 0.191 | 10.776 |

TABLE I-continued

| X-LOC | Y-LOC | Z-LOC |
|---|---|---|
| −1.094 | 0.264 | 10.776 |
| −1.193 | 0.338 | 10.776 |
| −1.286 | 0.411 | 10.776 |
| −1.374 | 0.485 | 10.776 |
| −1.456 | 0.557 | 10.776 |
| −1.532 | 0.629 | 10.776 |
| −1.6 | 0.697 | 10.776 |
| −1.66 | 0.759 | 10.776 |
| −1.712 | 0.817 | 10.776 |
| −1.757 | 0.869 | 10.776 |
| −1.794 | 0.915 | 10.776 |
| −1.825 | 0.955 | 10.776 |
| −1.85 | 0.99 | 10.776 |
| −1.871 | 1.019 | 10.776 |
| −1.887 | 1.044 | 10.776 |
| −1.898 | 1.065 | 10.776 |
| −1.906 | 1.082 | 10.776 |
| −1.911 | 1.095 | 10.776 |
| −1.913 | 1.106 | 10.776 |
| −1.913 | 1.116 | 10.776 |
| −1.91 | 1.122 | 10.776 |
| −1.904 | 1.125 | 10.776 |
| −1.895 | 1.126 | 10.776 |
| −1.884 | 1.124 | 10.776 |
| −1.871 | 1.12 | 10.776 |
| −1.855 | 1.113 | 10.776 |
| −1.834 | 1.103 | 10.776 |
| −1.809 | 1.088 | 10.776 |
| −1.78 | 1.069 | 10.776 |
| −1.745 | 1.047 | 10.776 |
| −1.704 | 1.02 | 10.776 |
| −1.656 | 0.988 | 10.776 |
| −1.601 | 0.951 | 10.776 |
| −1.538 | 0.908 | 10.776 |
| −1.468 | 0.861 | 10.776 |
| −1.39 | 0.81 | 10.776 |
| −1.305 | 0.754 | 10.776 |
| −1.215 | 0.696 | 10.776 |
| −1.121 | 0.637 | 10.776 |
| −1.023 | 0.577 | 10.776 |
| −0.92 | 0.515 | 10.776 |
| −0.812 | 0.453 | 10.776 |
| −0.7 | 0.39 | 10.776 |
| −0.583 | 0.326 | 10.776 |
| −0.466 | 0.264 | 10.776 |
| −0.348 | 0.203 | 10.776 |
| −0.229 | 0.144 | 10.776 |
| −0.11 | 0.086 | 10.776 |
| 0.01 | 0.028 | 10.776 |
| 0.131 | −0.028 | 10.776 |
| 0.251 | −0.083 | 10.776 |
| 0.373 | −0.137 | 10.776 |
| 0.494 | −0.19 | 10.776 |
| 0.616 | −0.242 | 10.776 |
| 0.739 | −0.293 | 10.776 |
| 0.858 | −0.342 | 10.776 |
| 0.973 | −0.389 | 10.776 |
| 1.084 | −0.433 | 10.776 |
| 1.191 | −0.474 | 10.776 |
| 1.295 | −0.513 | 10.776 |
| 1.395 | −0.55 | 10.776 |
| 1.49 | −0.586 | 10.776 |
| 1.582 | −0.619 | 10.776 |
| 1.666 | −0.649 | 10.776 |
| 1.741 | −0.675 | 10.776 |
| 1.808 | −0.699 | 10.776 |
| 1.871 | −0.721 | 10.776 |
| 1.925 | −0.739 | 10.776 |
| 1.967 | −0.753 | 10.776 |
| 2.001 | −0.765 | 10.776 |
| 2.026 | −0.773 | 10.776 |
| 2.043 | −0.783 | 10.776 |
| 2.048 | −0.793 | 10.776 |
| 2.049 | −0.8 | 10.776 |
| 2.049 | −0.804 | 10.776 |
| 2.049 | −0.806 | 10.776 |
| 2.048 | −0.806 | 10.776 |

TABLE I-continued

| X-LOC | Y-LOC | Z-LOC |
|---|---|---|
| 2.099 | −1.227 | 12.314 |
| 2.098 | −1.229 | 12.314 |
| 2.097 | −1.232 | 12.314 |
| 2.092 | −1.238 | 12.314 |
| 2.082 | −1.243 | 12.314 |
| 2.062 | −1.242 | 12.314 |
| 2.035 | −1.236 | 12.314 |
| 1.999 | −1.228 | 12.314 |
| 1.953 | −1.219 | 12.314 |
| 1.895 | −1.206 | 12.314 |
| 1.827 | −1.191 | 12.314 |
| 1.754 | −1.175 | 12.314 |
| 1.673 | −1.156 | 12.314 |
| 1.583 | −1.135 | 12.314 |
| 1.484 | −1.112 | 12.314 |
| 1.381 | −1.087 | 12.314 |
| 1.273 | −1.06 | 12.314 |
| 1.161 | −1.032 | 12.314 |
| 1.044 | −1.001 | 12.314 |
| 0.924 | −0.968 | 12.314 |
| 0.799 | −0.932 | 12.314 |
| 0.671 | −0.894 | 12.314 |
| 0.538 | −0.852 | 12.314 |
| 0.407 | −0.808 | 12.314 |
| 0.276 | −0.762 | 12.314 |
| 0.146 | −0.713 | 12.314 |
| 0.017 | −0.662 | 12.314 |
| −0.11 | −0.607 | 12.314 |
| −0.236 | −0.549 | 12.314 |
| −0.361 | −0.487 | 12.314 |
| −0.484 | −0.423 | 12.314 |
| −0.605 | −0.355 | 12.314 |
| −0.723 | −0.284 | 12.314 |
| −0.84 | −0.209 | 12.314 |
| −0.951 | −0.134 | 12.314 |
| −1.056 | −0.058 | 12.314 |
| −1.156 | 0.017 | 12.314 |
| −1.249 | 0.093 | 12.314 |
| −1.336 | 0.168 | 12.314 |
| −1.419 | 0.242 | 12.314 |
| −1.496 | 0.316 | 12.314 |
| −1.564 | 0.385 | 12.314 |
| −1.625 | 0.449 | 12.314 |
| −1.677 | 0.507 | 12.314 |
| −1.722 | 0.56 | 12.314 |
| −1.76 | 0.606 | 12.314 |
| −1.792 | 0.646 | 12.314 |
| −1.818 | 0.681 | 12.314 |
| −1.839 | 0.711 | 12.314 |
| −1.856 | 0.736 | 12.314 |
| −1.868 | 0.757 | 12.314 |
| −1.877 | 0.773 | 12.314 |
| −1.882 | 0.786 | 12.314 |
| −1.886 | 0.797 | 12.314 |
| −1.886 | 0.807 | 12.314 |
| −1.883 | 0.813 | 12.314 |
| −1.877 | 0.816 | 12.314 |
| −1.868 | 0.815 | 12.314 |
| −1.857 | 0.811 | 12.314 |
| −1.845 | 0.806 | 12.314 |
| −1.829 | 0.797 | 12.314 |
| −1.809 | 0.785 | 12.314 |
| −1.785 | 0.768 | 12.314 |
| −1.756 | 0.747 | 12.314 |
| −1.722 | 0.722 | 12.314 |
| −1.682 | 0.692 | 12.314 |
| −1.635 | 0.657 | 12.314 |
| −1.581 | 0.616 | 12.314 |
| −1.52 | 0.57 | 12.314 |
| −1.451 | 0.519 | 12.314 |
| −1.374 | 0.463 | 12.314 |
| −1.29 | 0.403 | 12.314 |
| −1.201 | 0.341 | 12.314 |
| −1.108 | 0.277 | 12.314 |
| −1.01 | 0.212 | 12.314 |
| −0.907 | 0.147 | 12.314 |
| −0.8 | 0.08 | 12.314 |

TABLE I-continued

| X-LOC | Y-LOC | Z-LOC |
|---|---|---|
| −0.688 | 0.013 | 12.314 |
| −0.571 | −0.055 | 12.314 |
| −0.452 | −0.121 | 12.314 |
| −0.333 | −0.185 | 12.314 |
| −0.213 | −0.248 | 12.314 |
| −0.093 | −0.309 | 12.314 |
| 0.028 | −0.369 | 12.314 |
| 0.15 | −0.428 | 12.314 |
| 0.272 | −0.485 | 12.314 |
| 0.395 | −0.542 | 12.314 |
| 0.518 | −0.597 | 12.314 |
| 0.642 | −0.651 | 12.314 |
| 0.766 | −0.704 | 12.314 |
| 0.887 | −0.755 | 12.314 |
| 1.003 | −0.803 | 12.314 |
| 1.116 | −0.848 | 12.314 |
| 1.225 | −0.891 | 12.314 |
| 1.33 | −0.931 | 12.314 |
| 1.432 | −0.97 | 12.314 |
| 1.529 | −1.005 | 12.314 |
| 1.622 | −1.039 | 12.314 |
| 1.708 | −1.069 | 12.314 |
| 1.784 | −1.096 | 12.314 |
| 1.852 | −1.119 | 12.314 |
| 1.916 | −1.141 | 12.314 |
| 1.972 | −1.16 | 12.314 |
| 2.015 | −1.174 | 12.314 |
| 2.049 | −1.186 | 12.314 |
| 2.075 | −1.194 | 12.314 |
| 2.093 | −1.203 | 12.314 |
| 2.099 | −1.213 | 12.314 |
| 2.1 | −1.22 | 12.314 |
| 2.1 | −1.223 | 12.314 |
| 2.1 | −1.225 | 12.314 |
| 2.099 | −1.226 | 12.314 |
| 2.213 | −1.677 | 13.853 |
| 2.212 | −1.679 | 13.853 |
| 2.211 | −1.682 | 13.853 |
| 2.205 | −1.688 | 13.853 |
| 2.194 | −1.692 | 13.853 |
| 2.173 | −1.689 | 13.853 |
| 2.145 | −1.682 | 13.853 |
| 2.108 | −1.672 | 13.853 |
| 2.061 | −1.66 | 13.853 |
| 2.001 | −1.644 | 13.853 |
| 1.931 | −1.626 | 13.853 |
| 1.857 | −1.606 | 13.853 |
| 1.773 | −1.582 | 13.853 |
| 1.681 | −1.556 | 13.853 |
| 1.579 | −1.527 | 13.853 |
| 1.473 | −1.495 | 13.853 |
| 1.362 | −1.462 | 13.853 |
| 1.247 | −1.426 | 13.853 |
| 1.128 | −1.387 | 13.853 |
| 1.005 | −1.346 | 13.853 |
| 0.878 | −1.302 | 13.853 |
| 0.747 | −1.254 | 13.853 |
| 0.612 | −1.203 | 13.853 |
| 0.477 | −1.15 | 13.853 |
| 0.344 | −1.094 | 13.853 |
| 0.212 | −1.036 | 13.853 |
| 0.081 | −0.976 | 13.853 |
| −0.049 | −0.913 | 13.853 |
| −0.177 | −0.846 | 13.853 |
| −0.304 | −0.777 | 13.853 |
| −0.429 | −0.705 | 13.853 |
| −0.552 | −0.63 | 13.853 |
| −0.672 | −0.552 | 13.853 |
| −0.791 | −0.471 | 13.853 |
| −0.903 | −0.39 | 13.853 |
| −1.009 | −0.309 | 13.853 |
| −1.109 | −0.228 | 13.853 |
| −1.203 | −0.148 | 13.853 |
| −1.292 | −0.068 | 13.853 |
| −1.376 | 0.011 | 13.853 |
| −1.454 | 0.088 | 13.853 |
| −1.524 | 0.161 | 13.853 |

TABLE I-continued

| X-LOC | Y-LOC | Z-LOC |
|---|---|---|
| −1.586 | 0.229 | 13.853 |
| −1.64 | 0.291 | 13.853 |
| −1.686 | 0.346 | 13.853 |
| −1.725 | 0.395 | 13.853 |
| −1.758 | 0.437 | 13.853 |
| −1.785 | 0.474 | 13.853 |
| −1.807 | 0.505 | 13.853 |
| −1.825 | 0.531 | 13.853 |
| −1.838 | 0.552 | 13.853 |
| −1.847 | 0.569 | 13.853 |
| −1.853 | 0.582 | 13.853 |
| −1.857 | 0.594 | 13.853 |
| −1.858 | 0.603 | 13.853 |
| −1.856 | 0.61 | 13.853 |
| −1.849 | 0.612 | 13.853 |
| −1.84 | 0.61 | 13.853 |
| −1.83 | 0.605 | 13.853 |
| −1.817 | 0.598 | 13.853 |
| −1.802 | 0.587 | 13.853 |
| −1.782 | 0.573 | 13.853 |
| −1.758 | 0.554 | 13.853 |
| −1.729 | 0.531 | 13.853 |
| −1.695 | 0.502 | 13.853 |
| −1.655 | 0.469 | 13.853 |
| −1.608 | 0.43 | 13.853 |
| −1.554 | 0.384 | 13.853 |
| −1.493 | 0.333 | 13.853 |
| −1.423 | 0.276 | 13.853 |
| −1.346 | 0.214 | 13.853 |
| −1.261 | 0.147 | 13.853 |
| −1.171 | 0.079 | 13.853 |
| −1.077 | 0.009 | 13.853 |
| −0.978 | −0.063 | 13.853 |
| −0.873 | −0.136 | 13.853 |
| −0.764 | −0.209 | 13.853 |
| −0.65 | −0.284 | 13.853 |
| −0.53 | −0.359 | 13.853 |
| −0.409 | −0.432 | 13.853 |
| −0.288 | −0.503 | 13.853 |
| −0.165 | −0.573 | 13.853 |
| −0.042 | −0.642 | 13.853 |
| 0.082 | −0.709 | 13.853 |
| 0.207 | −0.775 | 13.853 |
| 0.332 | −0.84 | 13.853 |
| 0.458 | −0.904 | 13.853 |
| 0.584 | −0.967 | 13.853 |
| 0.711 | −1.028 | 13.853 |
| 0.839 | −1.089 | 13.853 |
| 0.962 | −1.146 | 13.853 |
| 1.082 | −1.201 | 13.853 |
| 1.198 | −1.252 | 13.853 |
| 1.31 | −1.301 | 13.853 |
| 1.418 | −1.347 | 13.853 |
| 1.522 | −1.391 | 13.853 |
| 1.623 | −1.432 | 13.853 |
| 1.719 | −1.47 | 13.853 |
| 1.807 | −1.504 | 13.853 |
| 1.886 | −1.534 | 13.853 |
| 1.956 | −1.561 | 13.853 |
| 2.023 | −1.585 | 13.853 |
| 2.08 | −1.606 | 13.853 |
| 2.125 | −1.622 | 13.853 |
| 2.16 | −1.635 | 13.853 |
| 2.187 | −1.644 | 13.853 |
| 2.206 | −1.653 | 13.853 |
| 2.213 | −1.662 | 13.853 |
| 2.214 | −1.67 | 13.853 |
| 2.214 | −1.673 | 13.853 |
| 2.214 | −1.675 | 13.853 |
| 2.213 | −1.676 | 13.853 |
| 2.238 | −2.038 | 15.392 |
| 2.238 | −2.04 | 15.392 |
| 2.236 | −2.043 | 15.392 |
| 2.23 | −2.049 | 15.392 |
| 2.218 | −2.052 | 15.392 |
| 2.196 | −2.047 | 15.392 |
| 2.167 | −2.038 | 15.392 |

TABLE I-continued

| X-LOC | Y-LOC | Z-LOC |
|---|---|---|
| 2.128 | −2.027 | 15.392 |
| 2.08 | −2.014 | 15.392 |
| 2.018 | −1.995 | 15.392 |
| 1.946 | −1.973 | 15.392 |
| 1.869 | −1.949 | 15.392 |
| 1.783 | −1.921 | 15.392 |
| 1.688 | −1.889 | 15.392 |
| 1.584 | −1.853 | 15.392 |
| 1.475 | −1.814 | 15.392 |
| 1.362 | −1.772 | 15.392 |
| 1.245 | −1.727 | 15.392 |
| 1.124 | −1.678 | 15.392 |
| 0.999 | −1.626 | 15.392 |
| 0.871 | −1.57 | 15.392 |
| 0.738 | −1.51 | 15.392 |
| 0.602 | −1.445 | 15.392 |
| 0.468 | −1.378 | 15.392 |
| 0.334 | −1.309 | 15.392 |
| 0.202 | −1.237 | 15.392 |
| 0.071 | −1.163 | 15.392 |
| −0.059 | −1.087 | 15.392 |
| −0.187 | −1.007 | 15.392 |
| −0.313 | −0.926 | 15.392 |
| −0.437 | −0.841 | 15.392 |
| −0.56 | −0.753 | 15.392 |
| −0.68 | −0.663 | 15.392 |
| −0.797 | −0.569 | 15.392 |
| −0.908 | −0.475 | 15.392 |
| −1.013 | −0.381 | 15.392 |
| −1.111 | −0.289 | 15.392 |
| −1.204 | −0.197 | 15.392 |
| −1.29 | −0.107 | 15.392 |
| −1.371 | −0.019 | 15.392 |
| −1.446 | 0.067 | 15.392 |
| −1.513 | 0.148 | 15.392 |
| −1.573 | 0.223 | 15.392 |
| −1.624 | 0.291 | 15.392 |
| −1.668 | 0.352 | 15.392 |
| −1.706 | 0.405 | 15.392 |
| −1.737 | 0.451 | 15.392 |
| −1.762 | 0.491 | 15.392 |
| −1.783 | 0.525 | 15.392 |
| −1.8 | 0.553 | 15.392 |
| −1.812 | 0.576 | 15.392 |
| −1.82 | 0.594 | 15.392 |
| −1.826 | 0.608 | 15.392 |
| −1.829 | 0.62 | 15.392 |
| −1.831 | 0.63 | 15.392 |
| −1.828 | 0.637 | 15.392 |
| −1.821 | 0.638 | 15.392 |
| −1.812 | 0.634 | 15.392 |
| −1.802 | 0.628 | 15.392 |
| −1.789 | 0.62 | 15.392 |
| −1.774 | 0.608 | 15.392 |
| −1.755 | 0.591 | 15.392 |
| −1.731 | 0.569 | 15.392 |
| −1.703 | 0.542 | 15.392 |
| −1.67 | 0.51 | 15.392 |
| −1.632 | 0.472 | 15.392 |
| −1.586 | 0.427 | 15.392 |
| −1.534 | 0.376 | 15.392 |
| −1.474 | 0.317 | 15.392 |
| −1.407 | 0.253 | 15.392 |
| −1.331 | 0.182 | 15.392 |
| −1.248 | 0.106 | 15.392 |
| −1.16 | 0.027 | 15.392 |
| −1.067 | −0.053 | 15.392 |
| −0.97 | −0.135 | 15.392 |
| −0.867 | −0.219 | 15.392 |
| −0.759 | −0.304 | 15.392 |
| −0.646 | −0.39 | 15.392 |
| −0.527 | −0.477 | 15.392 |
| −0.407 | −0.562 | 15.392 |
| −0.285 | −0.645 | 15.392 |
| −0.163 | −0.726 | 15.392 |
| −0.039 | −0.806 | 15.392 |
| 0.085 | −0.885 | 15.392 |

TABLE I-continued

| X-LOC | Y-LOC | Z-LOC |
|---|---|---|
| 0.21 | −0.964 | 15.392 |
| 0.335 | −1.041 | 15.392 |
| 0.46 | −1.118 | 15.392 |
| 0.586 | −1.194 | 15.392 |
| 0.713 | −1.268 | 15.392 |
| 0.841 | −1.342 | 15.392 |
| 0.964 | −1.412 | 15.392 |
| 1.085 | −1.478 | 15.392 |
| 1.202 | −1.54 | 15.392 |
| 1.315 | −1.599 | 15.392 |
| 1.424 | −1.654 | 15.392 |
| 1.53 | −1.706 | 15.392 |
| 1.632 | −1.755 | 15.392 |
| 1.73 | −1.801 | 15.392 |
| 1.82 | −1.841 | 15.392 |
| 1.901 | −1.877 | 15.392 |
| 1.973 | −1.908 | 15.392 |
| 2.041 | −1.936 | 15.392 |
| 2.1 | −1.96 | 15.392 |
| 2.146 | −1.979 | 15.392 |
| 2.183 | −1.993 | 15.392 |
| 2.21 | −2.004 | 15.392 |
| 2.23 | −2.013 | 15.392 |
| 2.238 | −2.022 | 15.392 |
| 2.239 | −2.03 | 15.392 |
| 2.239 | −2.034 | 15.392 |
| 2.239 | −2.036 | 15.392 |
| 2.239 | −2.037 | 15.392 |

It will also be appreciated that the exemplary airfoil(s) disclosed in the above Table 1 may be scaled up or down geometrically for use in other similar compressor designs. Consequently, the coordinate values set forth in the Table 1 may be scaled upwardly or downwardly such that the airfoil profile shape remains unchanged. A scaled version of the coordinates in Table 1 would be represented by X, Y and Z coordinate values of Table 1 multiplied or divided by a constant.

While various embodiments are described herein, it will be appreciated from the specification that various combinations of elements, variations or improvements therein may be made by those skilled in the art, and are within the scope of the invention.

We claim:

1. An article of manufacture, the article having a nominal profile substantially in accordance with Cartesian coordinate values of X, Y and Z set forth in TABLE 1, and wherein X and Y are distances in inches which, when connected by smooth continuing arcs, define airfoil profile sections at each distance Z in inches, the profile sections at the Z distances being joined smoothly with one another to form a complete airfoil shape.

2. An article of manufacture according to claim 1, wherein the article comprises an airfoil.

3. An article of manufacture according to claim 2, wherein said article shape lies in an envelope within ±0.160 inches in a direction normal to any article surface location.

4. An article of manufacture according to claim 1, wherein the article comprises an airfoil variable stator vane.

5. A compressor comprising a compressor wheel having a plurality of articles of manufacture, each of said articles of manufacture including an airfoil having an airfoil shape, said airfoil having a nominal profile substantially in accordance with Cartesian coordinate values of X, Y and Z set forth in TABLE 1, wherein X and Y are distances in inches which, when connected by smooth continuing arcs, define the airfoil profile sections at each distance Z in inches, the profile sections at the Z distances being joined smoothly with one another to form a complete airfoil shape.

6. A compressor according to claim 5, wherein the article of manufacture comprises an airfoil variable stator vane.

7. A compressor comprising a compressor wheel having a plurality of articles of manufacture, each of said articles of manufacture including an airfoil having an uncoated nominal airfoil profile substantially in accordance with Cartesian coordinate values of X, Y and Z set forth in TABLE 1, wherein X and Y are distances in inches which, when connected by smooth continuing arcs, define airfoil profile sections at each distance Z in inches, the profile sections at the Z distances being joined smoothly with one another to form a complete airfoil shape, the X and Y distances being scalable as a function of the same constant or number to provide a scaled-up or scaled-down rotor blade airfoil.

8. A compressor according to claim 7, wherein the article of manufacture comprises an airfoil variable stator vane.

9. A compressor according to claim 7, wherein said airfoil shape lies in an envelope within ±0.160 inches in a direction normal to any airfoil surface location.

* * * * *